US007757778B2

(12) United States Patent
Calderwood

(10) Patent No.: US 7,757,778 B2
(45) Date of Patent: Jul. 20, 2010

(54) RIPPER BOOT

(76) Inventor: James A. Calderwood, 73 Oxford Terrace, Port Lincoln, South Australia 5606 (AU)

( * ) Notice: Subject to any disclaimer, the term of this patent is extended or adjusted under 35 U.S.C. 154(b) by 0 days.

(21) Appl. No.: 12/064,513

(22) PCT Filed: Aug. 24, 2006

(86) PCT No.: PCT/AU2006/001218

§ 371 (c)(1),
(2), (4) Date: Feb. 22, 2008

(87) PCT Pub. No.: WO2007/022579

PCT Pub. Date: Mar. 1, 2007

(65) Prior Publication Data

US 2008/0229627 A1 Sep. 25, 2008

(30) Foreign Application Priority Data

Aug. 24, 2005 (AU) ..... 2005904591
Aug. 26, 2005 (AU) ..... 2005204264

(51) Int. Cl.
*A01B 13/08* (2006.01)

(52) U.S. Cl. ..... 172/699

(58) Field of Classification Search ..... 37/446, 37/449, 450–456; 172/701.1, 701.3, 699, 172/664, 719, 749, 734–739, 772.5, 750–753; 299/106, 107; 403/361, 383
See application file for complete search history.

(56) References Cited

U.S. PATENT DOCUMENTS 1,845,677 A 2/1932 Mekeel
2,847,921 A 8/1958 Heckathorn
3,203,488 A 8/1965 Eastwood
3,312,004 A 4/1967 Johnson
3,550,691 A 12/1970 Davies
3,550,991 A 12/1970 Davies et al
3,585,741 A 6/1971 Heusler
3,984,910 A * 10/1976 Helton et al. ..... 419/1
4,013,130 A 3/1977 Wirt (Continued)

FOREIGN PATENT DOCUMENTS

EP 1174546 1/2002

(Continued)

OTHER PUBLICATIONS

Derwent Abstract Accession No. 91-1002002/14, Class Q42, SU 1564-289 A (Kiev Eng Cons Inst), May 15, 1990.

(Continued)

*Primary Examiner*—Robert E Pezzuto
(74) *Attorney, Agent, or Firm*—Weiner & Burt, P.C.; Irving M. Weiner; Pamela S. Burt

(57) ABSTRACT

Ripper boots of the type adapted to be mounted to a bulldozer tyne for use in cleaving through hard ground. The ripper boot includes a replaceable ripping tooth which is secured within the boot by interference fit so that during use, it does not rotate. The replaceable ripping tooth may be angled upwardly with respect to the carrier so that the angle of attack of the ripping tooth is raised so that it is almost parallel with the ground.

21 Claims, 8 Drawing Sheets

U.S. PATENT DOCUMENTS

| | | | | | |
|---|---|---|---|---|---|
| 4,083,605 | A * | 4/1978 | College et al. | 299/105 |
| 4,736,533 | A * | 4/1988 | May et al. | 37/456 |
| 5,152,088 | A * | 10/1992 | Hahn | 37/458 |
| 5,782,019 | A | 7/1998 | Launder | |
| 5,947,209 | A | 9/1999 | Halford | |
| 6,000,153 | A * | 12/1999 | Sollami | 37/453 |
| 6,247,255 | B1 * | 6/2001 | Clendenning | 37/452 |
| 6,478,383 | B1 * | 11/2002 | Ojanen et al. | 299/104 |
| 7,032,334 | B2 * | 4/2006 | Pippins | 37/455 |

FOREIGN PATENT DOCUMENTS

| | | |
|---|---|---|
| JP | S48-068716 | 8/1973 |
| JP | S48-071130 | 9/1973 |
| JP | S61-017791 | 2/1986 |
| RU | 2052099 | 1/1996 |
| RU | 2055191 | 2/1996 |

OTHER PUBLICATIONS

Nedra, "Gornoye delo" Terminology Dictionary, 1981, p. 414, Russia.

* cited by examiner

RIPPER BOOT

The present invention relates to an improved ripper boot and, in particular, to a ripper boot for use in a range of applications involving the ripping or cleaving of hard material. The preferred application of the present invention is in opal mining where hard ground is to be penetrated in an attempt to locate opal.

BACKGROUND OF THE INVENTION

Ripper boots are typically used where extremely hard rock or compacted soil is encountered and is required to be penetrated and ripped in an attempt to locate and extract precious stones such as opal. The ripper boot includes a carrier which is typically secured to a bulldozer tyne and a ripping tooth section secured to the nose of the carrier to rip through rock, typically to a depth of approximately 300 mm at a time. In the case of opal mining, the loosened rock is then pushed away, while spotters check for signs of opal. The ripping tooth can also be replaceable. The present inventor has identified some problems with such conventional ripper boots.

Firstly, some replaceable ripping tooth sections are secured to the boot in a rotatable manner. The problem with having a rotatable ripping tooth is that during operation, ground up rock is able to enter into the area between the shaft of the ripping tooth and the ripper boot body. This causes considerable wear and tear when the shaft rotates which may eventually lead to metal fatigue and fracture under extreme loads. A further problem is that the ripping tooth tends to move and chatter during operation which is also undesirable. Further still, where clay fines and other similar material build up in the area surrounding the ripping tooth shaft, the tooth becomes almost impossible to remove. Existing ripper boots having rotatable teeth are also expensive to manufacture, and their use is limited to only a small range of applications.

The present inventor has further discovered that the "angle of attack" is extremely important in ripping operations, that is, the angle at which the ripping boot rips through the ground. In conventional ripping operations, the angle of attack is typically governed by the angle at which the end of the bulldozer tyne extends because it is the tyne that carries the ripper boot. The position of the bulldozer tyne is adjustable, however, its movement is restricted and often a desired angle of attack is not attainable.

When the tooth is ripping at too steep an angle, that is, when the angle between the longitudinal axis of the ripping tooth and the ground surface is too great, the ripper boot will begin to chatter which may result in increased wear and tear on the ripping tooth, metal fatigue and eventual fracture in the ripping tooth. In such circumstances, the load on the bulldozer is also increased which leads to increased fuel consumption. The nose of the ripping tooth tip may also drag when the angle is too steep, and the ripping tooth is prone to being ripped out. In general, where the angle of attack is not correct, the required cleaving effect of the boot is reduced. In fact, it has been found that very small variations in ripping tooth angle can have major effects on the effectiveness of the ripping operation.

It is therefore an object of the present invention to overcome at least some of the aforementioned problems or to provide the public with a useful alternative.

SUMMARY OF THE INVENTION

Therefore in one form of the invention there is proposed a ripper boot characterized by:

a carrier adapted to be fixedly connected to a shank of a powered vehicle;

a tooth housing portion, said tooth housing portion including an inwardly tapered socket; and a tooth including a shaft and a head, said head being shorter than said shaft and constructed at least partially of high tensile material, and said shaft being correspondingly tapered with said socket for removable engagement therewith.

Preferably the head of said tooth is substantially half the length of the shaft.

In preference said removable engagement is by way of an interference fit achieved when the inner surface of the inwardly tapered socket and the outer surface of the correspondingly tapered shaft abut during operation.

In preference the cross section of the socket and tooth shank is square with rounded corners.

Alternatively the cross section of the socket and tooth shank is circular.

In preference the carrier includes a central longitudinal axis, and said tooth housing portion and socket are disposed along said longitudinal axis.

Preferably the tooth shaft and tooth housing portion include transverse channels extending therethrough, which become co-axially aligned when the shaft is engaged within said socket, to thereby allow for insertion of a retaining pin.

In preference the head of the tooth includes an outwardly extending shoulder adapted to facilitate removal of the tooth from within the socket.

Preferably said tooth housing means includes an ejection hole which extends from an exterior of the boot to a base area of said socket enabling ejection of the tooth using an appropriate tool.

Advantageously said tooth head is substantially conical in shape and terminates in a rounded tip, said tip being constructed of said high tensile material.

Preferably said high tensile tip is made of tungsten metal.

In a further form of the invention there is proposed a ripper boot of the type adapted to be mounted to a bulldozer shank or like equipment, said ripper boot including:

a carrier adapted to be fixedly connected to said shank, said carrier including a longitudinal axis;

a tooth housing portion including an inwardly tapered socket extending at a predetermined angle relative to said carrier longitudinal axis; and a tooth including a shaft and a head, said head being shorter than said shaft and constructed at least partially of high tensile material, and said shaft being correspondingly shaped with said socket for removable engagement therewith.

Preferably the head of said tooth is substantially half the length of the shaft.

In preference said removable engagement is by way of an interference fit achieved when the inner surface of the inwardly tapered socket and the outer surface of the correspondingly tapered shaft abut during operation.

In preference the cross section of the socket and tooth shank is square with rounded corners.

Alternatively the cross section of the socket and tooth shank is circular.

Preferably during use, the carrier is normally directed at an angle toward the surface being worked, and the angle of attack of the tooth is in a direction outwards from the carrier longitudinal axis such that the tooth head extends substantially parallel with said surface.

In preference said angle of attack is between zero and ninety degrees upwards from the longitudinal axis of the carrier.

Preferably said angle of attack is between zero and ten degrees upwards from the longitudinal axis of the carrier.

In preference said angle of attack is six degrees upwards from the longitudinal axis of the carrier.

Thus, this further form of the invention provides a ripper boot whereby the ripping tooth is angled upwardly with respect to the ripper boot carrier so that the angle of attack of the ripping tooth is raised and becomes almost parallel with the surface being ripped. In altering the angle of attack in this way, it has been found that the cleaving effect of the boot is increased, chatter and drag of the boot through the ground is reduced which results in less wear and tear and less likelihood of the tooth being ripped out, as well as decreased load on the bulldozer which also reduces fuel consumption.

Preferably said tooth mounting portion is in the form of a solid member which is integrally formed with said carrier, and extending at said predetermined angle therefrom. In preference said socket is defined within the solid member and extends along the same axis as the tooth mounting portion.

Alternatively said tooth mounting portion is in the form of a solid member which is integrally formed with said carrier, and extending along the carrier longitudinal axis. In preference said socket is defined within the solid member and extends at said predetermined angle relative to the carrier longitudinal axis.

Preferably the tooth shaft and tooth housing portion include transverse channels extending therethrough, which become co-axially aligned when the shaft is engaged within said socket, to thereby allow for insertion of a retaining pin.

In preference the head of the tooth includes an outwardly extending shoulder adapted to facilitate removal of the tooth from within the socket.

Preferably said tooth housing means includes an ejection hole which extends from an exterior of the boot to a base area of said socket enabling ejection of the tooth using an appropriate tool.

Preferably said tooth head is conical in shape and terminates in a rounded tip, said tip being constructed of said high tensile material.

Advantageously said high tensile tip is made of tungsten metal.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

Figure 1:
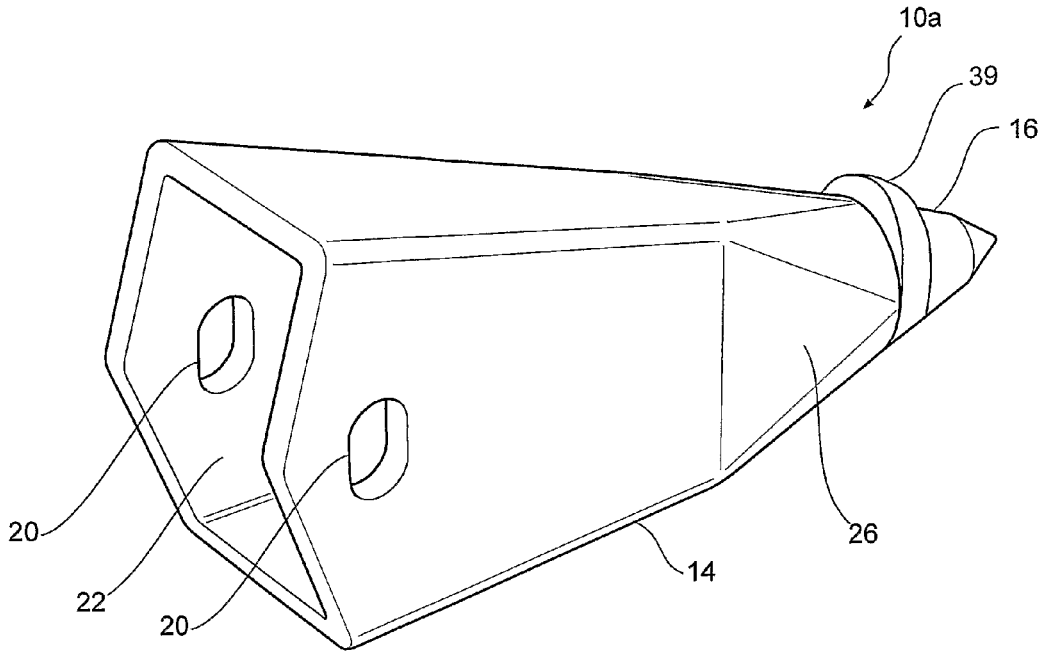
FIG. 1 illustrates a rear perspective view of an improved ripper boot in accordance with a first aspect of the present invention.
Figure 2:
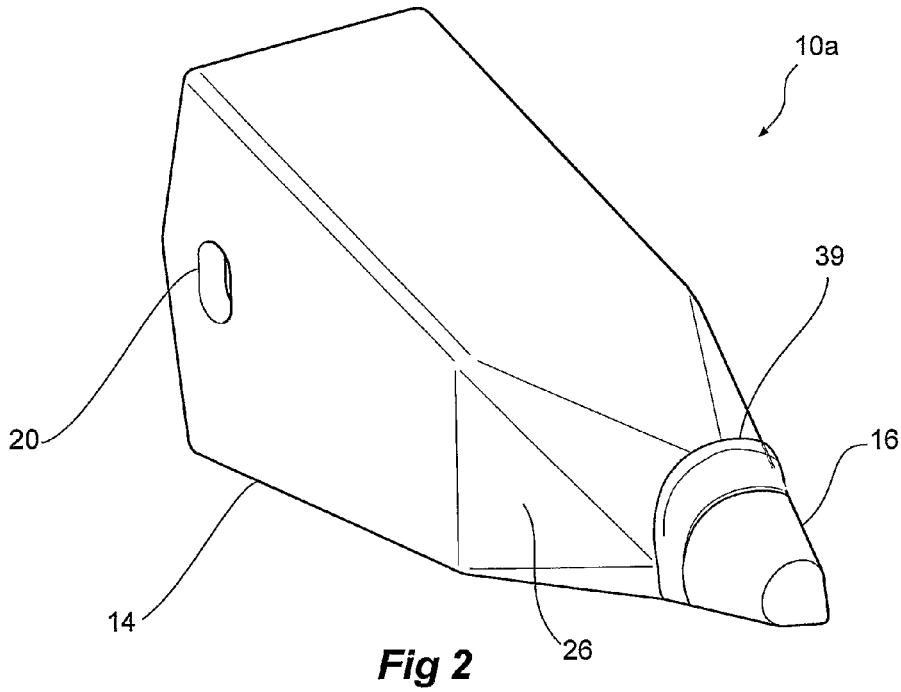
FIG. 2 illustrates a front perspective view of the improved ripper boot of FIG. 1.
Figure 3:
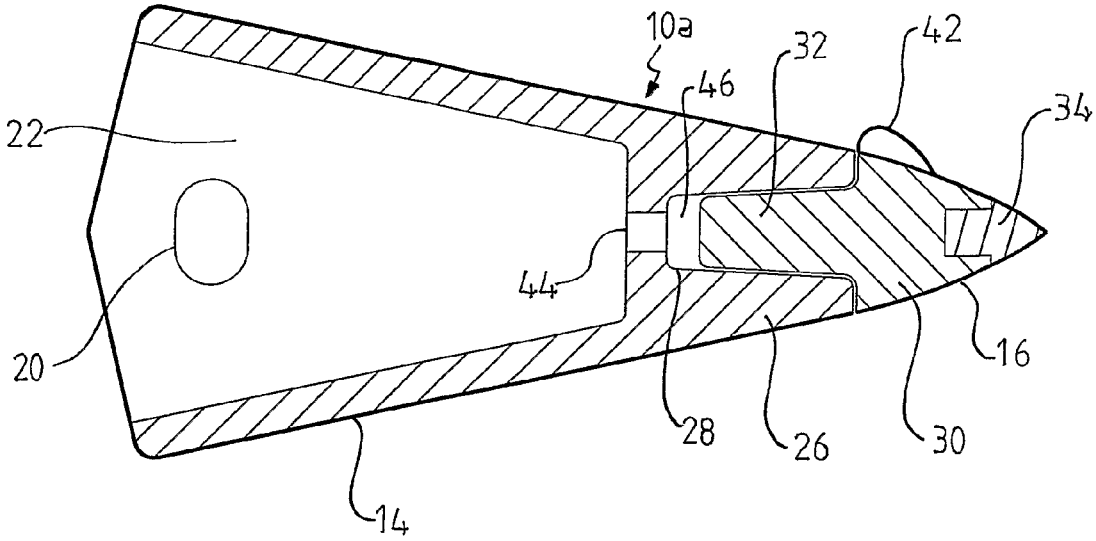
FIG. 3 illustrates a cross-sectional side view of the improved ripper boot of FIG. 1.
Figure 4:
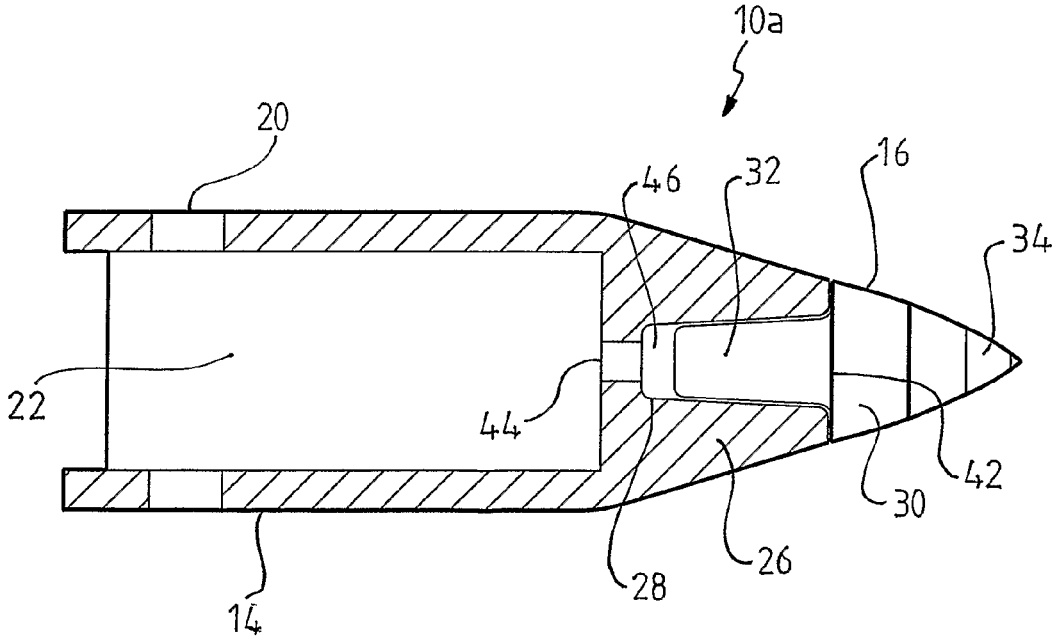
FIG. 4 illustrates a cross-sectional top view of the improved ripper boot Of FIG. 1.
Figure 5:
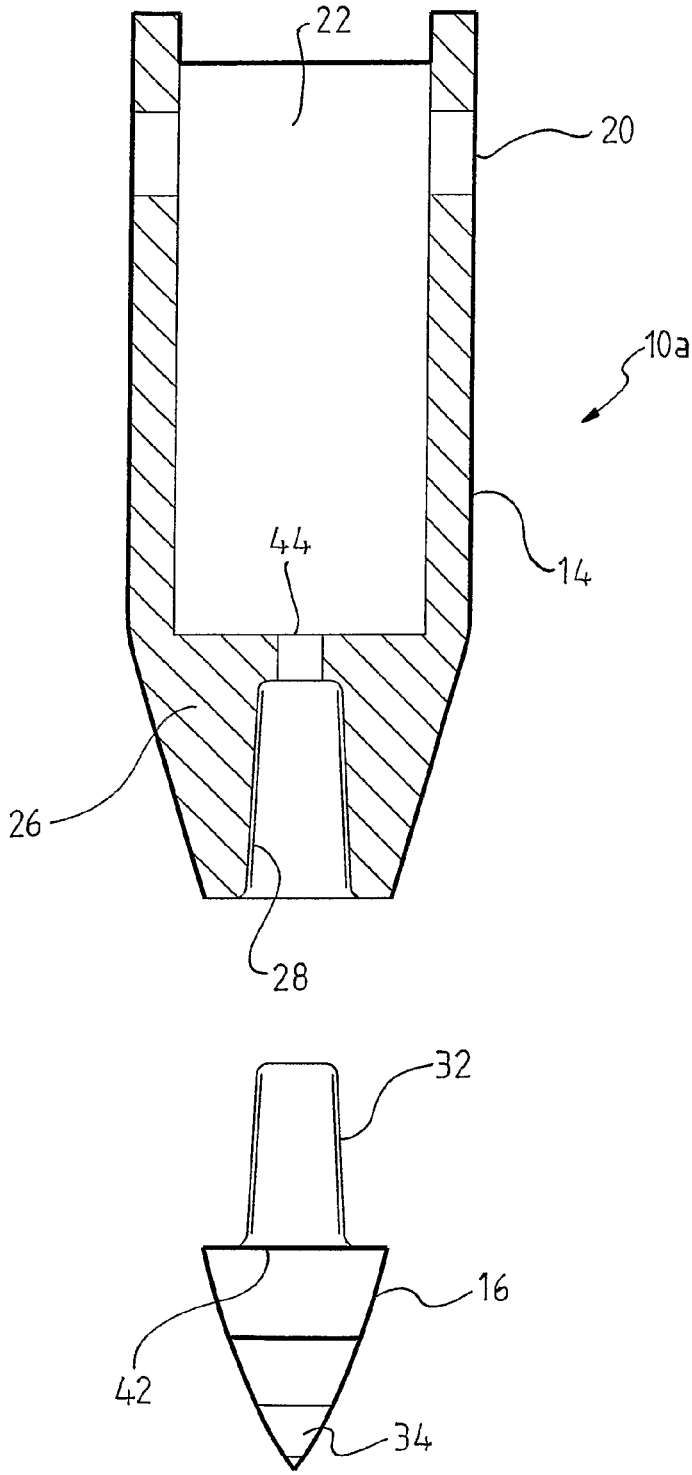
FIG. 5 illustrates an exploded, partially cross-sectional top view of the improved ripper boot of FIG. 1.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to an improved ripper boot according to three different embodiments 10*a*, 10*b* and 10*c*. The ripper boot 10*a* is illustrated in FIGS. 1-7, ripper boot 10*b* in FIGS. 8-10, and ripper boot 10*c* in FIGS. 11-12. FIG. 13 illustrates a bulldozer 12 to which any one of the ripper boots could be attached. For the purpose of brevity, the first ripper boot 10*a* will be described in full detail and any like parts found in the other ripper boots will not be described again and will be referred to using like numbers.

FIGS. 1-5 illustrate the ripper boot 10*a* of the present invention which includes a carrier 14 and a replaceable ripping tooth 16. In operation, the carrier 14 is placed over and conformed to fit with a ripper boot tyne 18 of a bulldozer 12 or other earth moving machinery, as is shown in FIG. 13. The various components of the bulldozer 12 are not described herein because bulldozers such as these are well known in the art, and apart from the ripper boot tyne 18, the remaining components do not perform any function insofar as the present invention is concerned.

The carrier 14 is held in place by utilization of a pair of oppositely positioned retaining holes 20 located in the rear hollow portion 22 of the carrier 14 which, in conjunction with a retaining pin 24, is designed to attach the carrier 14 of the ripper boot 10*a* to the available tyne 18. It is to be understood that the carrier 14 may be conformed to fit any available ripper boot shank, and that any desired attachment means other than the retaining pin 24 and oppositely positioned retaining holes 20 may be used.

The ripper boot carrier 14 also includes a substantially solid portion 26 at its front. This solid portion 26 provides mass and assists in the ripping mechanism to some degree. Primarily, the solid portion 26 provides a female socket or bore 28 adapted to fixedly house a replaceable ripping tooth 16. The bore 28 is of a square cross-section and includes longitudinal walls that taper inwardly such that the cross-sectional size of the bore 28 adjacent the hollow portion 22 is less than that adjacent the tooth end. All four edges of the socket 28 are rounded off for additional strength.

The replaceable ripping tooth 16 is made up of a head portion 30 and a shaft 32. The shaft 32 of the replaceable ripping tooth 14 is correspondingly shaped with the female socket 28 of the carrier 12, that is, it too includes tapered walls and is of a square cross-sectional shape having rounded corners. This allows the shaft 32 to be fixedly secured within the female socket 28 by way of an interference fit. As those skilled in the art would realize, an interference fit is extremely strong and will not permit any rotation at all of the replaceable ripping tooth 16 and ensures that no particles enter between the wall of the shaft 32 and the abutting wall of the female socket 28. In preference, the socket 28 is cast so as to ensure that its dimensions correspond with those of the shaft 32.

Once the tooth is fixed within the socket 28, the head portion 30 extends longitudinally outwards from the solid portion 26 of the boot and therefore tapers at substantially the same angle as the solid portion 26. The head portion 30 of the tooth is designed not to extend too far outwards from the carrier 14 so as to ensure it is not damaged or broken off during the ripping process. Mounted to the end of the replaceable ripping tooth 16 is a pointed tip 34 which can be made of high tensile strength material, such as tungsten for example. The tip 34 may simply be welded to the replaceable ripping tooth 16. A high tensile tip 34 ensures that even the hardest rock may be penetrated and that problems associated with existing ripper boot tips which become easily worn are minimized.

In attaching the replaceable ripping tooth 16 to the carrier 14 as described above, a number of benefits are provided.

Firstly, chatter is reduced during operation because the tooth 16 is fixed, and wear and tear on the tooth 16 is also reduced in that ground dirt can no longer enter the gap between the tooth shaft 32 and the female socket 28. This is a major problem with rotatable teeth in that particles abrade against the respective surfaces during operation and lead to metal fatigue and eventual failure in the tooth 16.

Secondly, the interference fit allows for easier removal of the ripping tooth 16 in that clay fines are no longer able to build up around the ripping tooth shaft 32. As mentioned in the preamble of the invention, this often prevents the tooth from being able to be removed. In this case, simply breaking the taper will cause the tooth to fall out, and a means of achieving this will be described shortly.

Thirdly, the ripper boot of the present invention is not limited in its use and may be used in association with a wide variety of machinery including small to large bulldozer rippers, end cutting bits on dozer blades, dragline buckets, bucket dredges, excavators, and loader bucket teeth. Such boots are also less expensive to manufacture.

Figure 6:
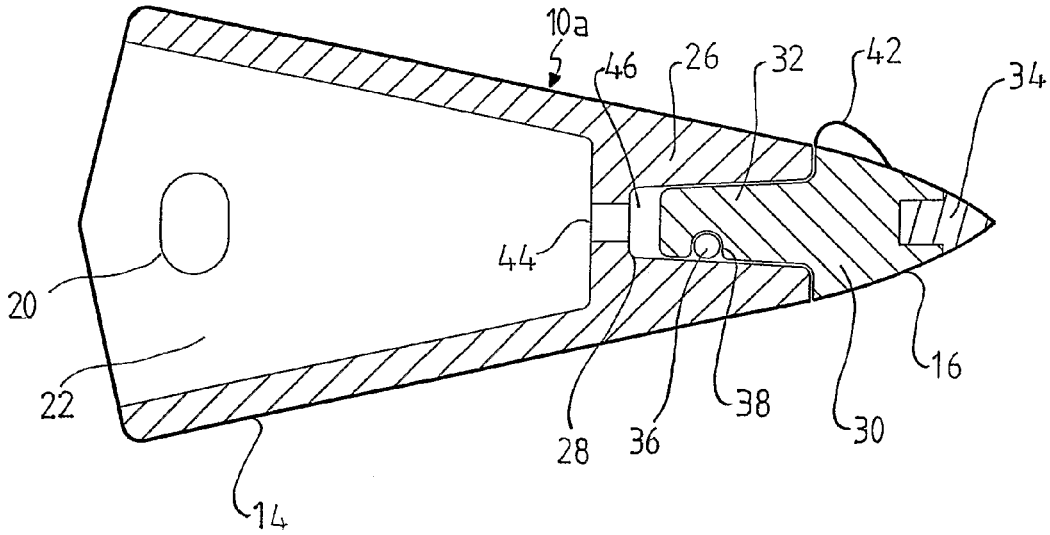
FIG. 6 illustrates a cross-sectional side view of an improved ripper boot including a retaining pin.
Figure 7:
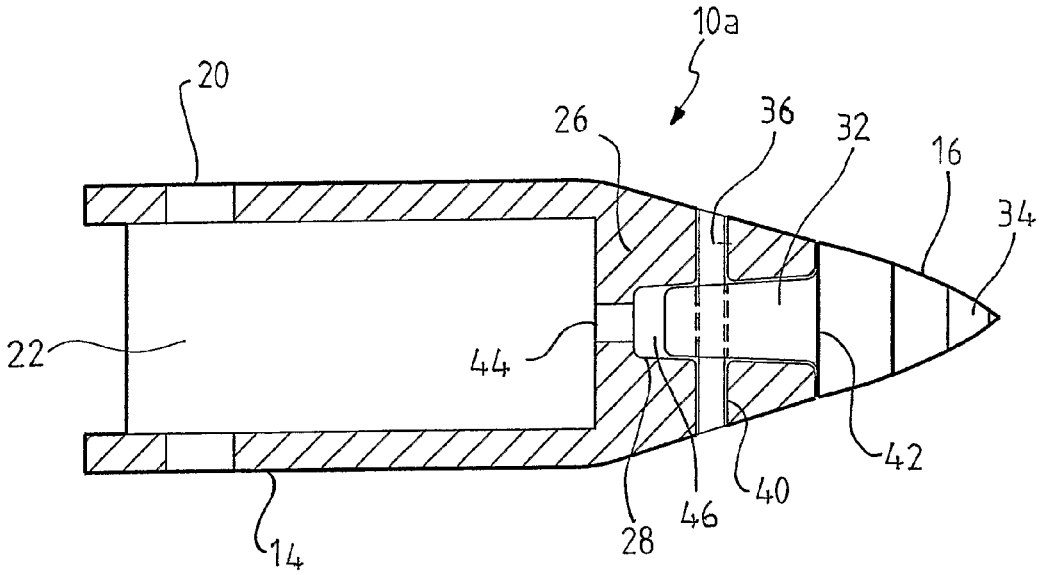
FIG. 7 illustrates a cross-sectional top view of an improved ripper boot including a retaining pin.

In order to ensure that the replaceable ripping tooth 16 is always fixed within the carrier 14 during use, a secondary locking means may also be used, preferably in the form of a retaining pin 36. Illustrated in FIGS. 6-7 is a ripper boot 10 including such a retaining pin 36. The tooth 16 includes a groove 38 extending transversely across a lower side thereof such that when it is fully inserted into socket 28, the groove 38 becomes co-axially aligned with an aperture 40 which extends transversely through the solid portion 26 of the carrier 12. Once aligned, the retaining pin 36 may simply be inserted through the aligned holes to lock the tooth in place.

It is envisaged that an interference fit is adequate in maintaining the tooth fixed within the socket, but a secondary locking means such as this may be used if required. The pin may be of the compressible type whereby prior to insertion, its cross section must be compressed so that following insertion it expands to provide a tighter fit. All other aspects of the ripper boot in FIGS. 6-7 are identical to those in the previous figures.

Removal of the ripping tooth 16 from the carrier 12 may be accomplished in a number of ways. The tooth 16 includes a protrusion or shoulder 42 extending outwards from the head portion 30 of the tooth 16 which is adapted to facilitate removal of the tooth 16. The shoulder 42 may be engaged by an appropriate tool and pried off when the tooth has become worn following prolonged use.

Alternatively, the ripping tooth 16 may be removed by way of insertion of a push rod (not shown) or other similar object through an ejection hole 44 extending from the hollow portion 22 of the carrier 14 to the female socket 28. As those skilled in the art would appreciate, when the ripping tooth 16 is locked within the female socket 28, such action will force the ripping tooth 16 from the female socket 28.

It is to be understood that the configuration of the ripping tooth 16 may vary. In this case, the pointed tip 34 includes a double inward taper before terminating into a point. This feature, combined with the high tensile properties of the tip 34, ensures that even the hardest rock may be penetrated with minimal slip and that problems associated with existing ripper boot tips which become easily worn are alleviated. But other types of tips may be used such as single taper tips, or curved tips. Further, the cross-sectional shape of the ripping tooth shaft 32 and carrier bore 28 need not be square but may be any other shape such as triangular or circular, provided an interference fit is still achievable.

It is to be further understood that the configuration of the female socket 28 in the area adjacent the end of the ripping tooth shaft 32 may also vary. For example, in the drawings there is shown a clearance 46 between the end of the shaft 32 and the end of the bore 28, as well as the ejection hole 44. Another variation could be for the tapered walls of the bore 28 to simply extend the entire distance through to the hollow portion 22 as is the case in the second and third embodiments of the invention. A still further variation may be where there is no gap at all between the hollow portion 22 of the boot 12 and the bore 28.

In using a replaceable ripping tooth that is adapted to be fixed during operation, such as those disclosed in the present invention, it has been found that previously encountered problems relating to ripper boot chatter, wear and tear on the ripping tooth, ripping tooth fracture, and other associated problems have been significantly reduced. More specifically, such ripper boots have resulted in benefits such as fuel savings of up to 10% due to reduced load on the bulldozer, savings of up to 50% in working time because of the ability to rip rock precisely, and total cost savings including manufacturing cost of up 10-20%.

Figure 8:
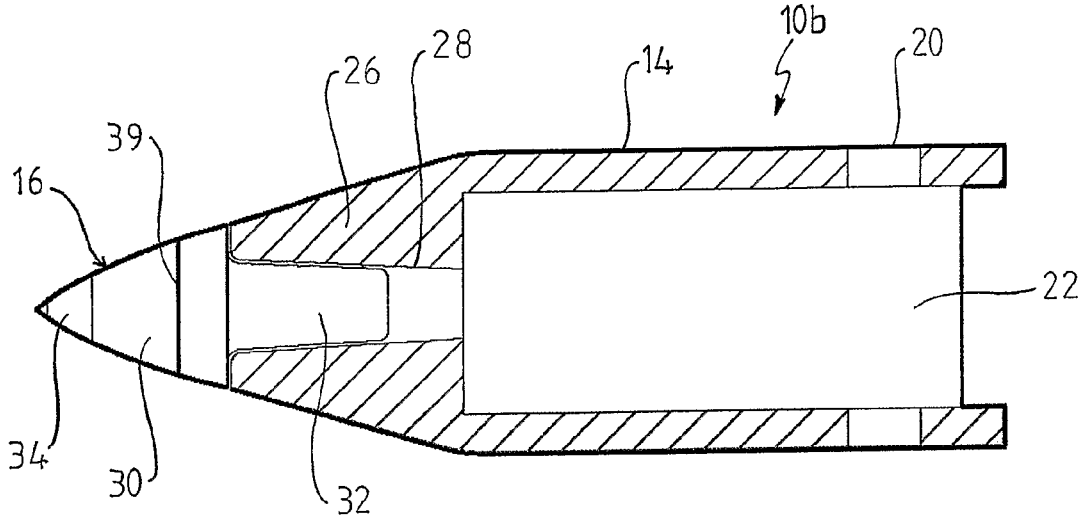
FIG. 8 illustrates a cross-sectional top view of an improved ripper boot in accordance with a second aspect of the present invention.
Figure 9:
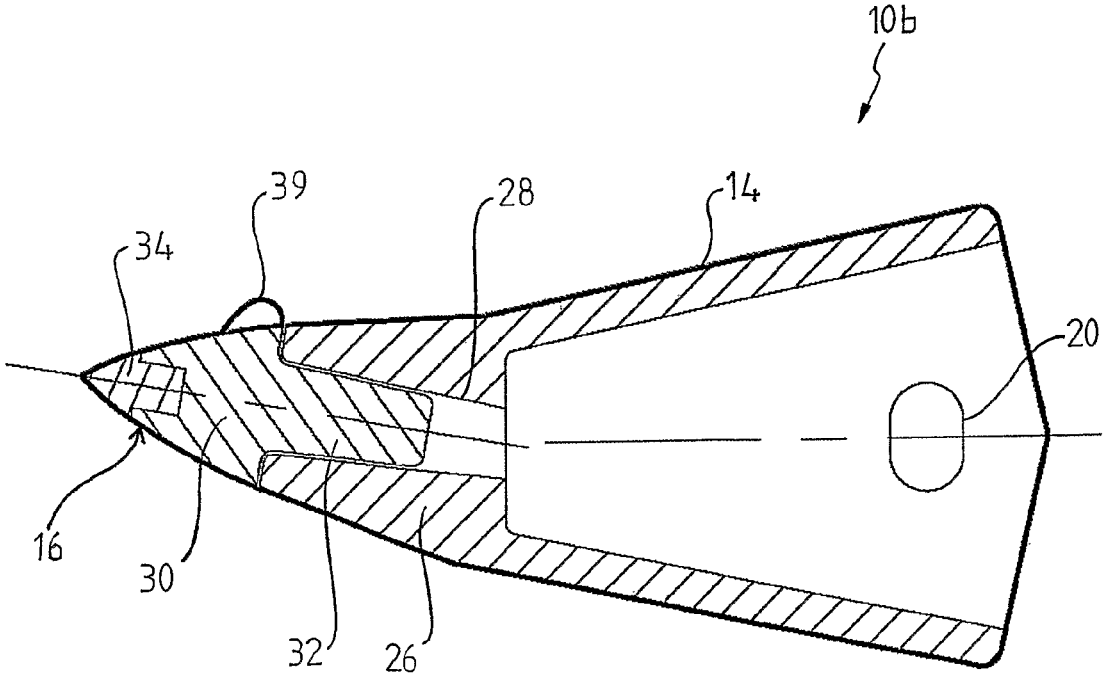
FIG. 9 illustrates a cross-sectional side view of the improved ripper boot of FIG. 8.

The second embodiment of the invention is illustrated in FIGS. 8-9 and relates to a ripper boot 10*b* which has the same interference fit tooth 16 as described above, but which includes an alternate angle of attack.

Figure 10:
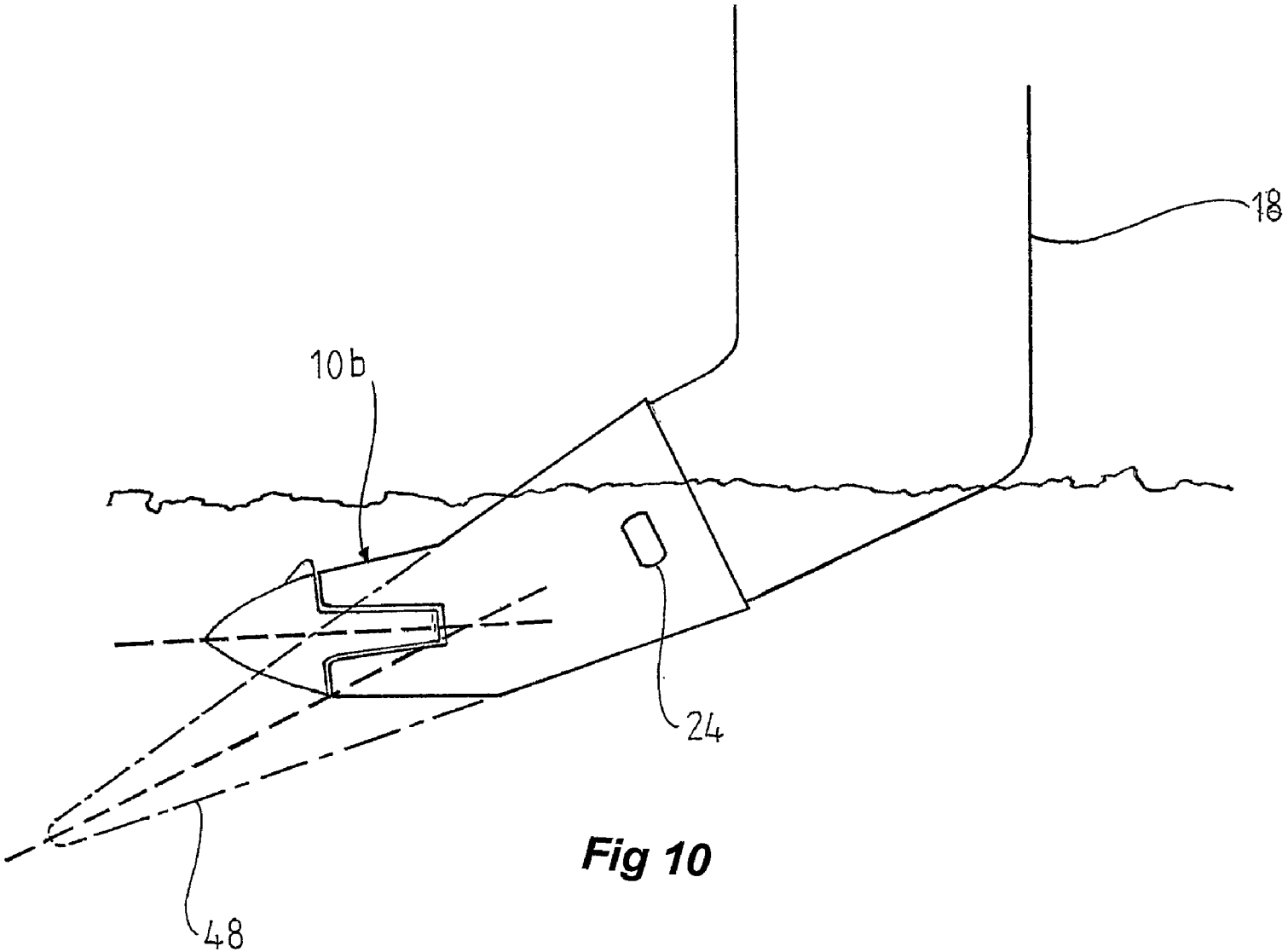
FIG. 10 illustrates a schematic side view of the improved ripper boot of FIG. 8 when the boot is connected to a bulldozer tyne, and shown in broken lines is a conventional ripper boot arrangement.

This angle of attack concept can be clearly appreciated in FIG. 10 which illustrates the ripper boot 10*b* of the present invention, as well as a conventional ripper boot 48 in broken lines for the purpose of comparison. Those skilled in the art will appreciate that where the solid portion of the conventional ripper boot 48 extends in the same longitudinal direction as that of the carrier 14, the solid portion 26 of the ripper boot 10*b* is angled upwardly with respect to the carrier 14 when fully assembled. In having an upwardly angled solid portion 26, those skilled in the art will appreciate that the ripping tooth 16 once inserted will also be angled with respect to the carrier 14.

The angle of the solid portion 26 is shown in the drawings to be quite substantial for the purpose of clarity, however, through experimentation it has been found that an angle of approximately 6 degrees from the longitudinal axis of the carrier body is optimal. At this angle, the outer surface of the ripping tooth becomes aligned approximately parallel with the layers of rock being cleaved. These layers are typically, but not always, parallel with the ground surface.

Existing ripper boots may be modified to include the features of ripper boot 10*b*. For example, a saw cut may be made at the junction between the carrier 14 and the solid portion 26 of the ripper boot 10*a* of the first embodiment. The cut would be made at a desired angle relative to the longitudinal axis of the carrier. Then, when a solid portion is welded to the angled end of the carrier 14, those skilled in the art will appreciate that it will extend at an angle corresponding with the angle of the cut.

It has been found that when the tooth is positioned at this angle, the boot cleaves through the ground more efficiently than hitherto known ripper boot arrangements resulting in similar benefits to those mentioned above including reduced chatter, reduced wear and tear on the tooth, and reduced load on the bulldozer. It is to be understood that the angle at which the solid portion 26 extends with respect to the carrier 14 may be made to vary depending on the required operation.

Figure 11:
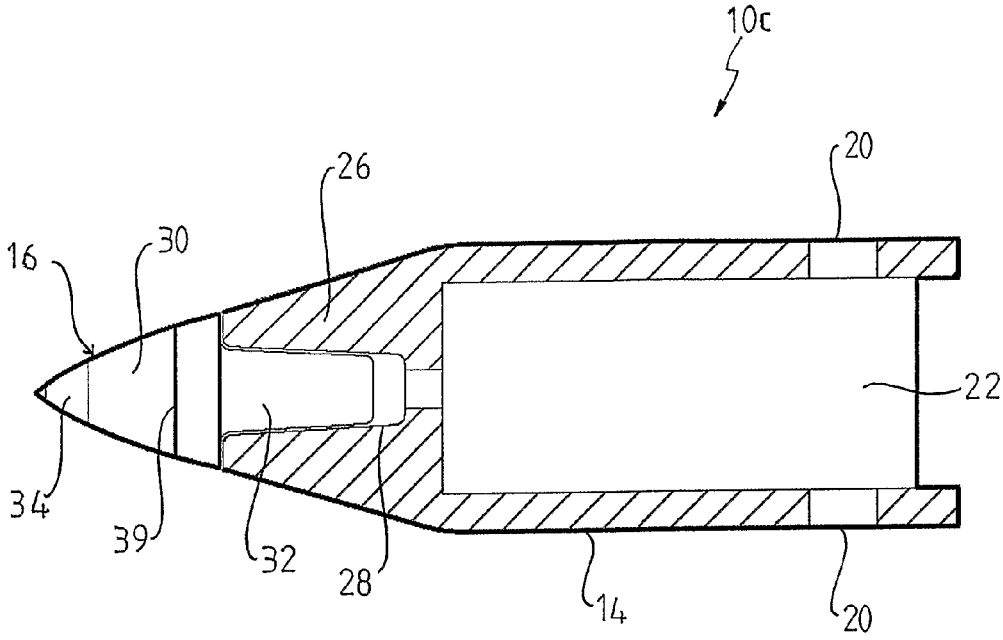
FIG. 11 illustrates a cross-sectional top view of an improved ripper boot in accordance with a third aspect of the present invention.
Figure 12:
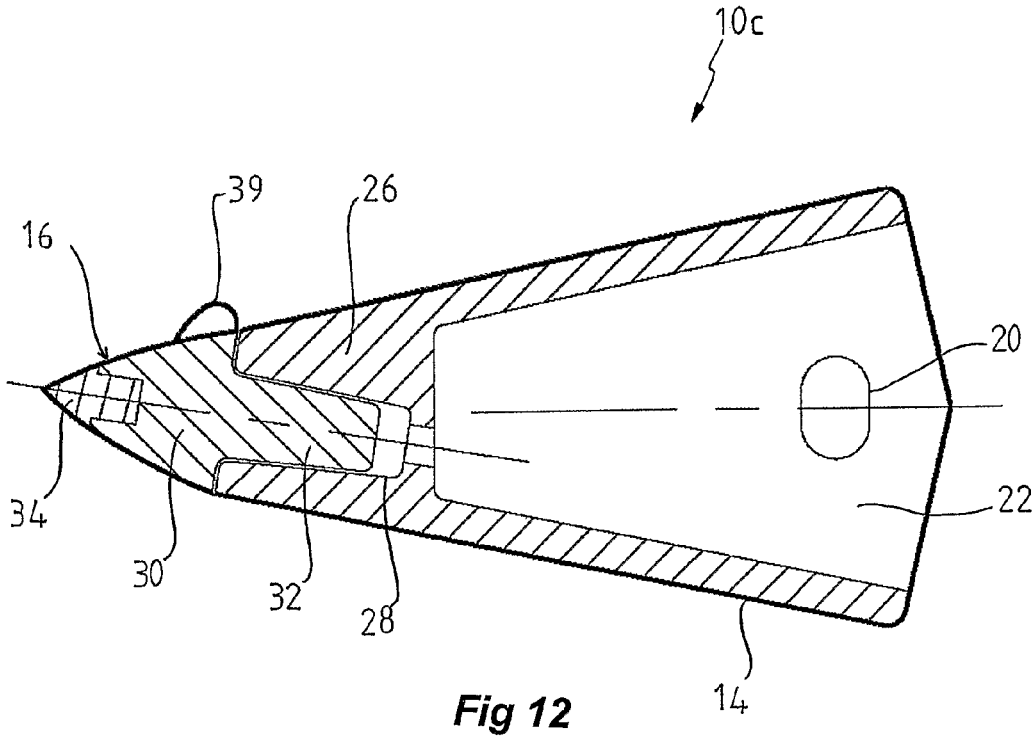
FIG. 12 illustrates a cross-sectional side view of the improved ripper boot of FIG. 11.
Figure 13:
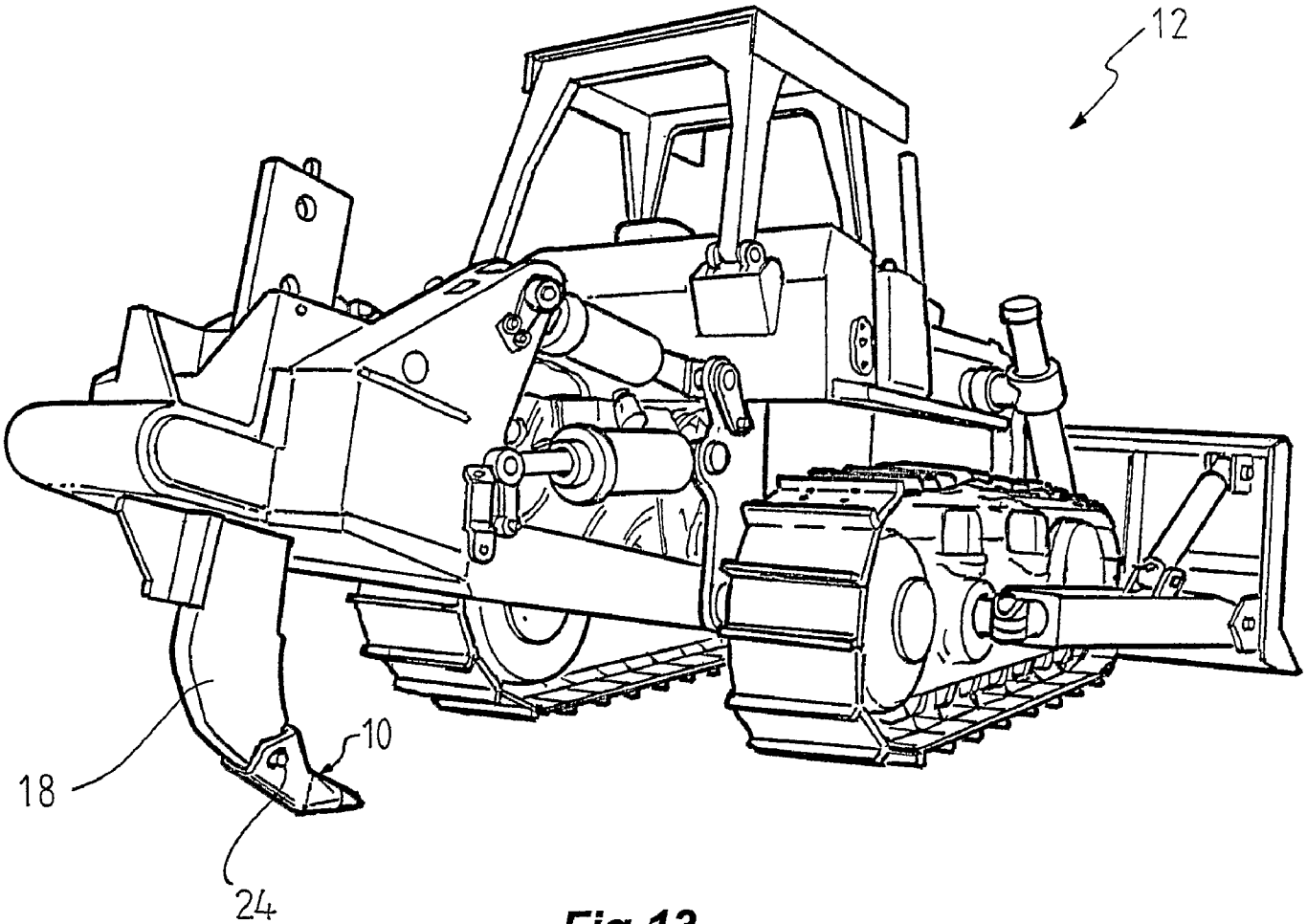
FIG. 13 illustrates a bulldozer including an improved ripper boot mounted to the bulldozer tyne in accordance with all aspects of the present invention.

FIGS. 11-12 illustrate a ripper boot 10*c* according to a third aspect of the present invention. The ripper boot 10*c* differs from the ripper boot 10*b* slightly in that rather than the solid portion 26 of the boot being angled, it extends longitudinally with respect to the carrier 12 as was the case in the ripper boot 10*a* of the first embodiment. In this case though, a raised angle of attack is achieved by having a female socket 28 cast at a predetermined angle through the solid portion 26 of the boot so that the ripping tooth 16 may extend outwards therefrom at that angle. Again, for the purpose of brevity, the same reference numbers have been used.

The angle is such that in use, the ripping tooth 16 will extend slightly upwardly so as to become more parallel with the ground surface. The benefits of having a raised angle of attack as provided by this third embodiment of the invention have been described above.

Although not illustrated, it is to be understood that this ripper boot 10*c* could also include a retaining pin for additional support as described previously.

Ripper boot 10*a* could also be modified to include an angled ripping tooth according to this third embodiment by making a straight saw cut at the junction between the carrier 12 and the solid portion 26 and simply replacing the solid portion with one that has an angled bore cast there through.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A ripper boot, comprising:

a replaceable ripping tooth and an associated socket in a ripper boot carrier;

said replaceable ripping tooth being secured within said ripper boot carrier by way of an interference fit so that during use said replaceable ripping tooth does not rotate;

said interference fit prevents particulate matter from entering between walls of said tooth and said associated socket;

said tooth has a tapered shank;

said socket has a tapered bore to mate with said tapered shank;

said tooth has a substantially conical outer shape and terminates in a tip;

said tip is fabricated from a high tensile material;

retaining means for retaining said tooth in said carrier;

loosening means for loosening said tooth from said carrier;

wherein:

said carrier is adapted to be fixedly connected to a shank of a powered vehicle;

said tooth includes a head being constructed at least partially of high tensile material;

said carrier and said tooth engage by a mating relationship between said socket and said correspondingly shaped tooth shank, said socket and tapered shank being inwardly tapered to thereby establish a taper lock between the carrier and tooth, said tooth being removable from the carrier when said taper lock is broken;

said inwardly tapered socket forms part of a tooth housing portion in said carrier, and said correspondingly shaped tooth shank forms part of the tooth;

the tooth shank and tooth housing portion include transverse channels extending therethrough, which become co-axially aligned when the tooth shank is engaged within said socket, to allow for insertion of a retaining pin;

the head of the tooth includes an outwardly extending shoulder adapted to facilitate removal of the tooth; and said tooth housing portion includes an ejection hole which extends from an exterior of the boot to a base area of said socket enabling ejection of the tooth using an appropriate tool.

2. A ripper boot, comprising:

a replaceable ripping tooth and an associated socket in a ripper boot carrier;

said replaceable ripping tooth being secured within said ripper boot carrier by way of an interference fit so that during use said replaceable ripping tooth does not rotate;

said interference fit prevents particulate matter from entering between walls of said tooth and said associated socket;

said tooth has a tapered shank;

said socket has a tapered bore to mate with said tapered shank;

said tooth has a substantially conical outer shape and terminates in a tip;

said tip is fabricated from a high tensile material;

retaining means for retaining said tooth in said carrier;

loosening means for loosening said tooth from said carrier;

said carrier is adapted to be fixedly connected to a shank of a powered vehicle;

said tooth includes a head being constructed at least partially of high tensile material;

said carrier and said tooth engage by a mating relationship between said socket and said correspondingly shaped tooth shank, said socket and tooth shank being inwardly tapered to thereby establish a taper lock between the carrier and tooth, said tooth being removable from the carrier when said taper lock is broken;

said inwardly tapered socket forms part of a tooth housing portion in said carrier, and said correspondingly shaped tooth shank forms part of the tooth;

the carrier includes a central longitudinal axis, and said tooth housing portion and socket are disposed along said longitudinal axis; and the tooth shank and tooth housing portion include transverse channels extending therethrough, which become co-axially aligned when the shank is engaged within said socket, to allow for insertion of a retaining pin.

3. A ripper boot, comprising:

a replaceable ripping tooth and an associated socket in a ripper boot carrier;

said replaceable ripping tooth being non-rotatably secured within said ripper boot carrier by way of locking interference fit so that during use said replaceable ripping tooth does not rotate;

said locking interference fit prevents particulate matter from entering between walls of said tooth and said associated socket;

said tooth has a locking tapered shank;

said socket has a locking tapered bore to mate with said locking tapered shank;

said tooth has a substantially conical outer shape and terminates in a tip; and said tip is fabricated from a high tensile material.

4. A ripper boot according to claim 3, wherein:

said carrier is adapted to be fixedly connected to a shank of a powered vehicle;

said tooth includes a head being constructed at least partially of high tensile material; and wherein said carrier and said tooth engage by a mating relationship between said socket and said correspondingly shaped tooth shank, said socket and tooth shank being inwardly tapered to thereby establish a taper lock between the carrier and tooth, said tooth being removable from the carrier when said taper lock is broken.

5. A ripper boot as in claim 4 wherein said inwardly tapered socket forms part of a tooth housing portion in said carrier, and said correspondingly shaped tooth shank forms part of the tooth.

6. A ripper boot as in claim 5 wherein the head of said tooth is substantially half the length of the tooth shank.

7. A ripper boot as characterised in claim 5 wherein said taper lock is established when an inner surface of the inwardly tapered socket and an outer surface of the correspondingly tapered tooth shank abut during operation.

8. A ripper boot as characterised in claim 5 wherein the cross section of the socket and tooth shank is square with rounded corners.

9. A ripper boot as characterised in claim 5 wherein the cross section of the socket and tooth shank is circular.

10. A ripper boot as characterised in claim 5 wherein the carrier includes a central longitudinal axis, and said tooth housing portion and socket are disposed along said longitudinal axis.

11. A ripper boot as characterised in claim 10 wherein the tooth shank and tooth housing portion include transverse channels extending therethrough, which become co-axially aligned when the shank is engaged within said socket, to allow for insertion of a retaining pin.

12. A ripper boot as characterised in claim 4 wherein the head of the tooth includes an outwardly extending shoulder adapted to facilitate removal of the tooth.

13. A ripper boot as characterised in claim 5 wherein said tooth housing portion includes an ejection hole which extends from an exterior of the boot to a base area of said socket enabling ejection of the tooth using an appropriate tool.

14. A ripper boot as characterised in claim 3 wherein said high tensile tip is made of tungsten metal.

15. A ripper boot as characterised in claim 4 wherein during use, the carrier is normally directed at an angle toward a surface being worked, and the angle of attack of the tooth is in a direction outwards from the carrier longitudinal axis such that the tooth head extends substantially parallel with said surface.

16. A ripper boot as characterised in claim 15 wherein said angle of attack is between zero and ninety degrees upwards from the longitudinal axis of the carrier.

17. A ripper boot as characterised in claim 15 wherein said angle of attack is between zero and ten degrees upwards from the longitudinal axis of the carrier.

18. A ripper boot as characterised in claim 15 wherein said angle of attack is six degrees upwards from the longitudinal axis of the carrier.

19. A ripper boot as characterised in claim 5 wherein said tooth housing portion is in the form of a solid member which is integrally formed with said carrier, and extending at a predetermined angle therefrom.

20. A ripping boot as characterised in claim 5 wherein said tooth housing portion is in the form of a solid member which is integrally formed with said carrier, and extending along the carrier longitudinal axis.

21. A ripping boot as characterised in claim 20 wherein said socket is defined within the solid member and extends at a predetermined angle relative to the carrier longitudinal axis.

* * * * *